United States Patent [19]

Ricketts

[11] 4,420,916

[45] Dec. 20, 1983

[54] METHOD AND APPARATUS FOR ALIGNING AND SECURING AUXILIARY EQUIPMENT WITH RESPECT TO A WELL DRILLING PLATFORM

[75] Inventor: William H. Ricketts, Muskogee, Okla.

[73] Assignee: Muskogee Environmental Conservation Co., Muskogee, Okla.

[21] Appl. No.: 323,291

[22] Filed: Nov. 20, 1981

[51] Int. Cl.[3] ..... B65G 7/00; E21B 7/02

[52] U.S. Cl. ..... 52/122.1; 52/143; 52/745; 52/126.1; 175/207

[58] Field of Search ..... 52/169.4, 115, 147, 52/149, 151, 146, 143, 148, 745, 150, 152, 167, 292, 126.1, 122.1, 126.5; 175/85, 207, 206; 166/351, 360; 173/22, 23, 28, 147, 151

[56] References Cited

U.S. PATENT DOCUMENTS

| | | | |
|---|---|---|---|
| 3,604,166 | 7/1969 | Ciccarelli | 52/122.1 X |
| 4,100,714 | 7/1978 | Stith, Jr. | 52/126.1 X |
| 4,198,797 | 4/1980 | Soble | 52/745 X |

*Primary Examiner*—John E. Murtagh
*Assistant Examiner*—Kathryn Ford
*Attorney, Agent, or Firm*—Head, Johnson & Stevenson

[57] ABSTRACT

A method and apparatus for aligning and securing auxiliary equipment and structures with respect to a well drilling platform comprising a pair of elongated hydraulic jacks spaced apart in a non-parallel configuration, said jacks being pivotally secured between the base portions of the drilling platform and the auxiliary structure and lying in a substantially horizontal plane, whereupon, activation of the jacks pulls the auxiliary structure into substantial alignment and spacing with respect to the drilling platform. Upon alignment and spacing, a pair of pivotal connecting links secures the base portion of the structure to the base portion of the platform and including a pair of longitudinally adjustable upper connecting links secured between the upper portions of the platform and the structure whereby adjustment in length of said upper connecting links compensates for a slightly unlevel drilling site, said auxiliary structure serving to stabilize said platform against side loads.

19 Claims, 7 Drawing Figures

METHOD AND APPARATUS FOR ALIGNING AND SECURING AUXILIARY EQUIPMENT WITH RESPECT TO A WELL DRILLING PLATFORM

BACKGROUND OF THE INVENTION

1. Field of the Invention

The present invention relates to the field alignment and securing of large pieces of equipment and structures together and more particularly, but not by way of limitation, to a method and apparatus for aligning and securing auxiliary equipment and structures with respect to a well drilling platform.

2. History of the Prior Art

The present emphasis in locating new sources of hydrocarbon products, namely oil and gas, has given rise to an unprecedented number of rotary drill rigs in operation across the United States and in foreign countries.

However, during this time of greatly increased drilling activity, the cost of drilling equipment and labor has skyrocketed to the extent that efficiency in operation is of paramount importance and can often represent the difference between a feasible drilling operation and staggering monetary losses.

The cost outlay of drill rigs for medium deep wells of twelve thousand feet or the like is so high that operators lease the equipment for very large sums of money on a daily basis. Hence, it is of great importance that the equipment be very portable so that there is a minimum of down time involved in tearing down the equipment, loading it onto a fleet of trucks, moving to a new drill site and setting up a new drilling operation.

However, associated with each drill rig are three major pieces of equipment or structures which must be in accurate alignment with respect to each other. The central structure is the drilling platform, which supports the upright derrick and which is positioned over the borehole site.

Integrally associated with the drilling platform is a rather large structure known in the field as a control room, sometimes referred to as the "dog house". The control room contains an assortment of equipment, including hydraulic and pneumatic pumps, electrical generators, control devices and the like for controlling and operating the drilling function which is taking place on the drilling platform. This necessitates the use of several connecting lines for providing hydraulic fluid, pneumatic lines, electrical cable and fuel lines connecting the control room with the drilling platform. Some of these lines are high-pressure lines and require hard-line connections as opposed to flexible hose connections.

The connecting of the lines between the control room and the drilling platform requires that the control room be very accurately positioned with respect to the drilling platform in order to effect the necessary plumbing and electrical connections.

The third large structure associated with the drill rig is the drilling mud tank that serves to filter and hold the drilling mud for continuous use in the drilling operation. Although the alignment of the mud tank with respect to the drilling platform is not as critical as that of the control room, it is nonetheless important and plays a large factor in set up time to begin a drilling operation.

Prior to the setting up of a drill rig, the site is prepared and leveled to the extent possible depending on the terrain. The drill platform is then placed into position over the prospective bore-hole. The auxiliary equipment, comprising the control room and the mud tank are then placed into position, usually on either side of the platform. The derrick is then pivoted into a vertical position for the drilling operation.

However, since the handling of the auxiliary equipment is usually by large cranes or the like, it is not unusual that as much as three or even four days is spent aligning the control room with respect to the drilling platform in an attempt to make the necessary plumbing connections. This often results in connecting pipes being broken, electrical wiring being damaged and lost time in searching out various shaped adapters in order to complete the connections.

To point out the inefficiency of the present set up procedures, a well of approximately twelve thousand feet only takes about twenty days of drilling time. Therefore, often a fifth of the total time of the drilling operation is spent attempting to align and connect the control room and the mud tank with respect to the well platform.

Another problem associated with the present design of drill rigs is their vulnerability to storms and high winds. The derrick and associated rigging on a medium-size rig will extend some one hundred thirty feet above the top of the platform, which itself is some twelve feet above ground level. Instability comes not only from side loadings due to wind, but occurs during the raising and lowering of the derrick itself and the handling of large pieces of equipment, such as well casing, which must be pulled off of horizontal pipe racks and up to the derrick structure. The side loads and instability caused from wind is often increased due to bundles of drilling tube being carried by the derrick itself in a vertical position. Often during drilling operations in the Plains states, the rig may experience unexpected high winds and gusts resulting in the rig actually being toppled over causing injury or even death to the drilling operators, but at the very least, virtually destroying the drill rig.

The present method of stabilizing the drilling platform consists of one or more large vertically disposed doors hinged along the bottom of the drilling platform. When the platform is in place, the doors are swung outwardly into contact with the ground and secured in an open position in an attempt to effectively increase the surface area of the platform offering extra stability for the platform against side loading.

However, these doors have met with only limited success and every year several drill rigs are destroyed due to toppling over for one reason or another.

Some manufacturers have even resorted to the construction of enlarged drilling platforms to stabilize the rig but this results in wasted space and material and greatly detracts from the portability of the rig.

SUMMARY OF THE INVENTION

The present invention provides a method and apparatus for aligning and securing the control room and the mud tank with respect to the drilling platform to facilitate connecting the control lines of the equipment and to provide greatly increased stability to the drilling platform and associated derrick.

The platform is an elongated structure having a vertically disposed derrick mounted thereon. The length of the platform near the derrick is, in effect, extended due to a skid ramp and stairs which extends from the ground up to the top of the platform. The control room is also an elongated structure set at a right angle with respect to the platform and positioned about six feet therefrom. The mud tank is also an elongated structure which is positioned parallel to the platform on the opposite side from the control room and also spaced approximately six feet from the platform.

A first pair of elongated hydraulic jacks are provided having one end pivotally secured to each side of the base portion of the control room and may be extended longitudinally and outwardly with the opposite end of each jack being pivotally attachable to a base portion of the drilling platform. The control room is mounted on skid booms to facilitate its being pulled across the ground.

A first pair of spaced-apart, parallel link arms are pivotally connected between the base portions of the control room and the platform with suitable horizontal pivot pins. A second pair of spaced-apart, parallel and adjustable link arms are pivotally connected between upper portions of the control room and the platform and are located generally directly above the first pair of link arms.

A second pair of elongated hydraulic jacks are provided having one end pivotally connected to the base portion of the opposite side of the platform in a spaced-apart relationship. The jacks are extendable longitudinally and outwardly with the opposite ends being pivotally connected to the base portion of the mud tank.

A third pair of spaced-apart parallel link arms are pivotally connected between the base portions of the mud tank and the platform with suitable horizontal pivot pins and a fourth pair of spaced-apart, adjustable parallel link arms are pivotally secured between the upper portions of the mud tank and the platform.

In operation, the drill site is prepared and leveled and the drilling platform is positioned over the proposed bore-hole site. The control room is placed in near alignment with the drilling platform and about four feet outwardly from its desired location with respect to the drilling platform.

The first hydraulic jacks carried by the control room and which are connected to a hydraulic power source are extended longitudinally and outwardly and connected by vertical pivot pins to the drilling platform. The jacks are then hydraulically retracted pulling the control room into its desired location with respect to the platform. The first pair of lower connecting link arms are then secured between the base portions of the control room and the platform by aligned horizontal pivot pins.

The second or upper pair of connecting arms are then adjusted in length and connected between the upper portions of the control room and the platform again by a pair of aligned horizontal pivot pins. The upper arms are made adjustable to accommodate the equipment being slightly out of level due to the imperfection in preparing the site. The pivotal attachment points for the hydraulic jacks and the connecting links are pre-positioned so that once the upper links are connected, the structures are aligned and spaced so that hard hydraulic lines, fuel lines and the like may be easily connected.

The connecting links and hydraulic jacks are locked into position to virtually eliminate relative movement between the two structures thus eliminating the tendency to overturn and cause damage to the rig.

The mud tank is attached to the opposite side of the drilling platform in a similar manner and then may, but not necessarily, be filled with drilling mud to provide greater stability.

At this point, the derrick may be pivotally attached to the platform and raised into position, the platform having a significantly greater stability due to the auxiliary structures being connected by hard links.

It can be seen that when the drilling platform experiences side loads toward either the mud tank or the control room, the loads are transmitted by compression and tension forces through the connecting links to the mud tank and control room.

Likewise, when the derrick experiences side loading in a longitudinal direction, a significant portion of the load is transmitted to the mud tank and control room by torsion loading through the connecting links thereby greatly increasing the effective platform surface area severalfold.

Field testing of a completed drill rig implementing the teachings of the present invention has indicated that alignment of the control room and mud tank by the present method and apparatus takes approximately thirty minutes to an hour, making the connection of the major structures making up a drill rig an incidental part of set up time rather than the controlling factor.

The hydraulic jacks are also adapted to be pivoted alongside of one of the structures and easily stowed for transportation. This is also true of the pairs of connecting links carried by the various structures.

DESCRIPTION OF THE DRAWINGS

Other and further advantageous features of the present invention will hereinafter more fully appear in connection with a detailed description of the drawings in which.

DESCRIPTION OF THE PREFERRED EMBODIMENT

Figure 1:
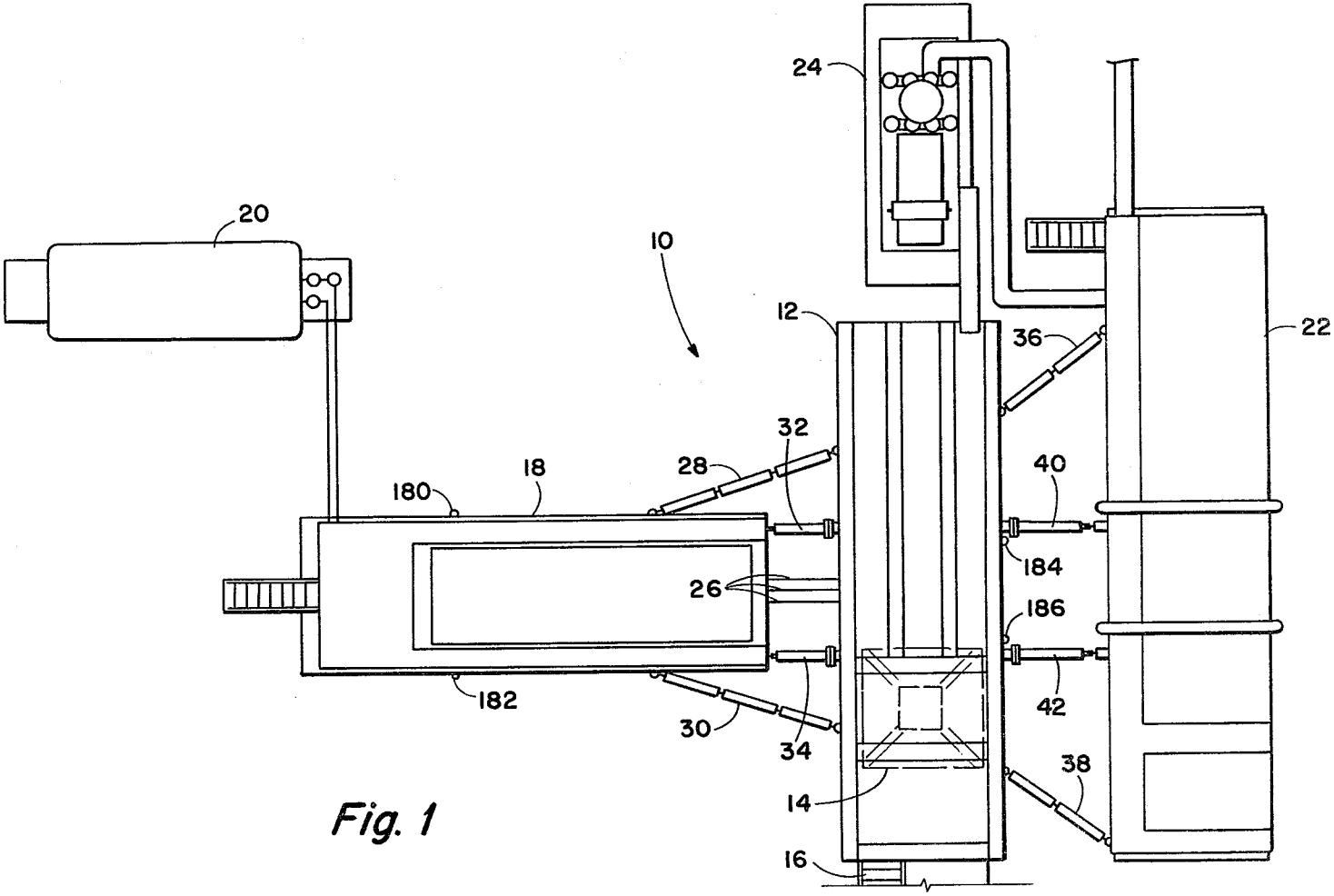
FIG. 1 is an overall plan view of a drill rig ready for operation including alignment and connecting apparatus embodying the present invention.

Referring to the drawings in detail, reference character 10 generally indicates a well drilling rig comprising an elongated drilling platform 12 and associated vertical derrick 14, the platform 12 also comprising a ramp structure 16 at one end thereof connecting the upper portion of the platform to the ground. The rig also comprises an elongated control room structure 18 which is positioned at substantially right angles with respect to the platform 12 and spaced therefrom and a fuel supply tank 20 having connecting lines to the control room 18. The rig also comprises an elongated mud tank 22 which is positioned parallel to the platform 12 and spaced therefrom and an associated tail-drive mud pump assembly 24 which is operably connected to the mud tank 22 and the platform 12.

Also connected between the control room 18 and the platform 12 are a plurality of hydraulic, pneumatic and electrical lines indicated by reference character 26, some of which are hard lines and some of which are flexible.

The rig 10 further comprises a first pair of elongated hydraulic jacks 28 and 30 which are non-parallel and connectable between base portions of the control room 18 and the platform 12. A first pair of upper elongated parallel connecting links 32 and 34 are pivotally connectable between upper portions of the control room 18 and the platform 12 for a purpose that will be hereinafter set forth.

A second pair of elongated hydraulic jacks 36 and 38 are disposed non-parallel and operably connected between base portions of the drilling platform 12 and the mud tank 22. A second set of elongated adjustable connecting links 40 and 42 are spaced apart and parallel and are pivotally connectable between upper portions of the drilling platform 12 and the mud tank 22.

Figure 2:
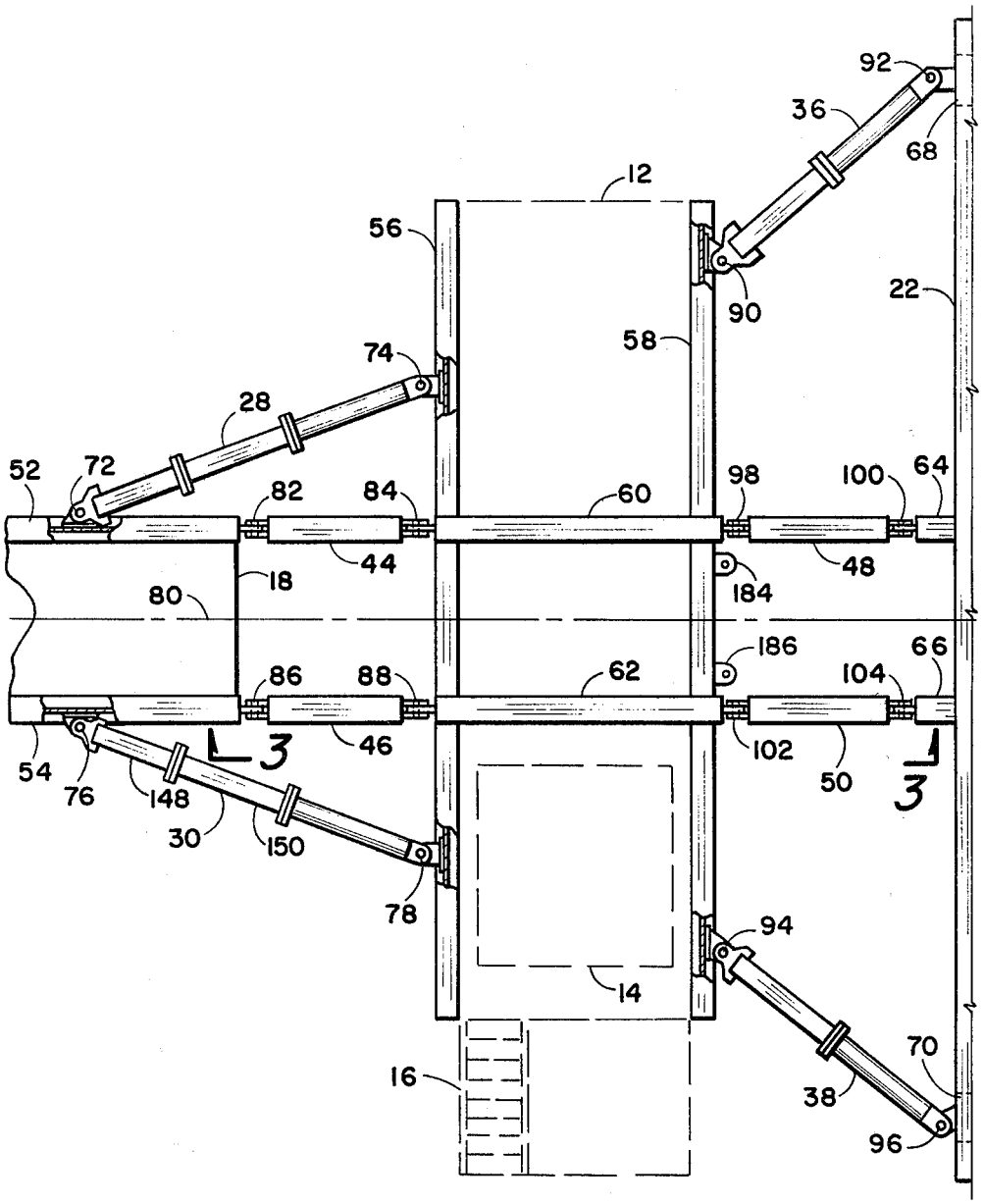
FIG. 2 is a plan view shown partially in section, of the lower connecting structure of the rig of FIG. 1.

Referring to FIG. 2 of the drawings, a pair of substantially parallel connecting links 44 and 46 are pivotally connected between base portions of the control room 18 and the platform 12 and a similar pair of connecting links 48 and 50 are pivotally connected between base portions of the drilling platform 12 and the mud tank 22.

A base portion of the control room comprises a pair of parallel skid booms 52 and 54 which may be of I-beam construction and serve to allow the control room to be skidded along the surface of the ground for a purpose that will be hereinafter set forth.

The base portion of the drilling platform comprises a pair of parallel longitudinal I-beams 56 and 58 which, in turn, support a pair of spaced parallel cross members 60 and 62. The base portion of the mud tank comprises at least two parallel transverse skid booms 64 and 66 which are of approximately the same spacing as the cross members 60 and 62 of the drilling platform which, in turn, are of essentially the same spacing as the skid booms 52 and 54 of the control room.

The base portion of the mud tank may also comprise at least two additional skid booms or structural members 68 and 70. The elongated hydraulic link 28 is pivotally attached at each end by vertical pivot points 72 and 74 to the skid boom 52 and the longitudinal beam 56. It is noted that the pivot pin 72 is spaced from the inner end of the control room as shown in FIG. 2.

The hydraulic jack 30 is pivotally attached to the skid boom 54 by pivot pin 76, the opposite end being attachable to the beam 56 by pivot pin 78 in a similar manner. It is noted also that the spacing of the pivot pins 74 and 78 is wider than the spacing of the pivot pins 72 and 76 thereby forming a Y-shaped configuration about an axis line depicted by reference character 80. The connecting link 44 is secured between the end of the skid boom 52 and the cross frame member 60 by horizontal pivot pins 82 and 84, respectively. Likewise, the connecting link 46 is secured between the skid boom 54 and the cross frame member 62 by horizontal pivot pins 86 and 88.

The hydraulic jack 36 is secured between the longitudinal frame member 58 and the skid boom 68 by suitable vertical pivot pins 90 and 92, respectively, while the hydraulic jack 38 is secured between the longitudinal beam 58 and the skid boom 70 by suitable vertical pivot pins 94 and 96, respectively. It is noted that the spacing between the pivot pins 92 and 96 is wider than the spacing of the pivot pins 90 and 94 thereby, again, forming a substantially Y-shaped configuration about the axis line 80.

The connecting link 48 is secured between the cross frame member 60 and the skid boom 64 by horizontal pivot pins 98 and 100 while the connecting link 50 is secured between the cross member 62 and the skid boom 66 by horizontal pivot pins 102 and 104. Therefore, it can be seen that the hydraulic jacks 28, 30, 36 and 38 are substantially horizontally disposed while the pairs of connecting links 44–46 and 48–50, while being relatively parallel are disposed at a slight angle with respect to the horizontal as can be seen more clearly in the drawing of FIG. 3.

Figure 3:
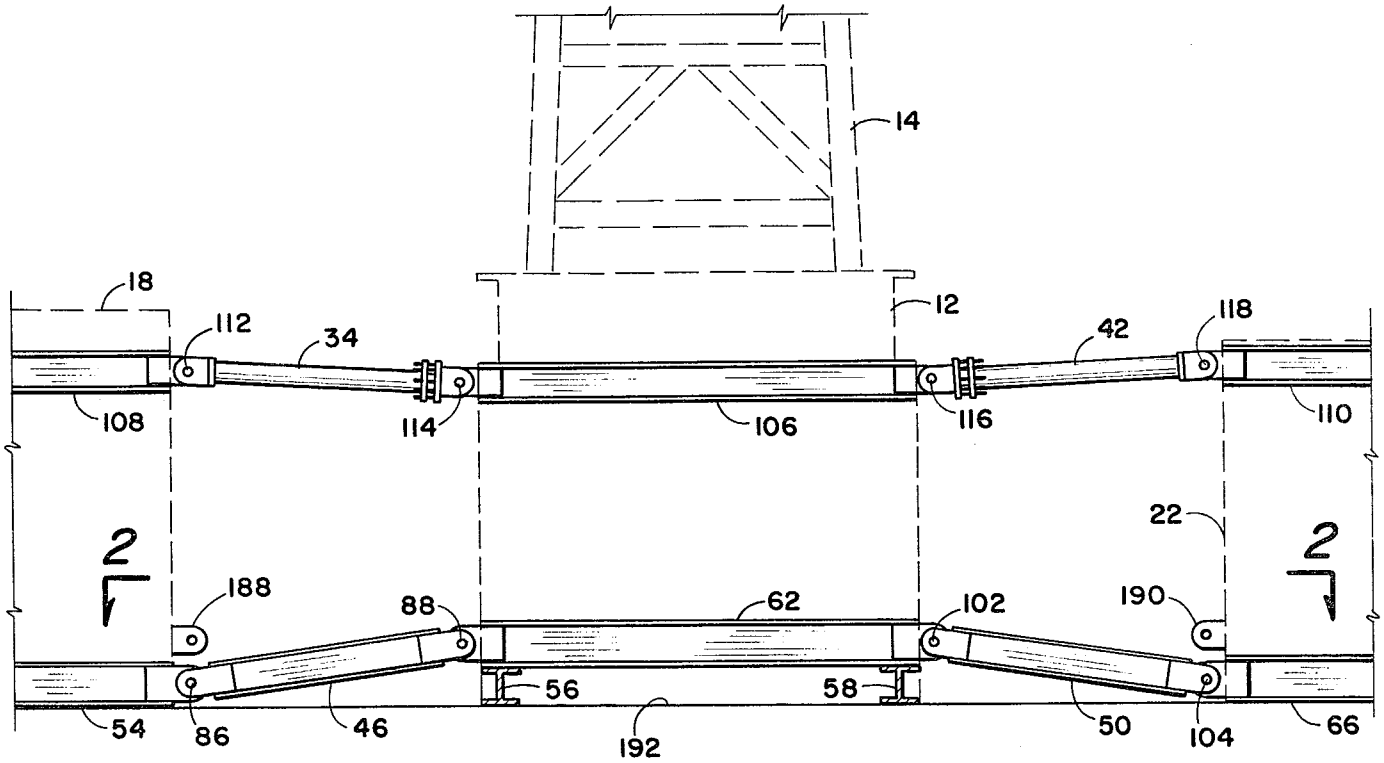
FIG. 3 is a side elevational sectional view of the apparatus of FIG. 2 taken along the broken lines 3—3 of FIG. 2.

Referring now to FIG. 3 of the drawings, the platform 12 further comprises upper transversely disposed frame members, such as member 106, which are in substantial alignment with upper frame members 108 of the drilling platform 18 and 110 of the mud tank 22. The adjustable connecting links 32 and 34 are pivotally connected between upper frame members 108 and 106 by horizontal pivot pins 112 and 114, respectively, while the upper connecting links 40 and 42 are connected between frame members 106 and 110 by horizontal pivot pins 116 and 118, respectively. While FIG. 3 shows only connecting links 34 and 42, the connecting links 32 and 40 are similarly connected and appear on FIG. 1 of the drawings.

Figure 5:
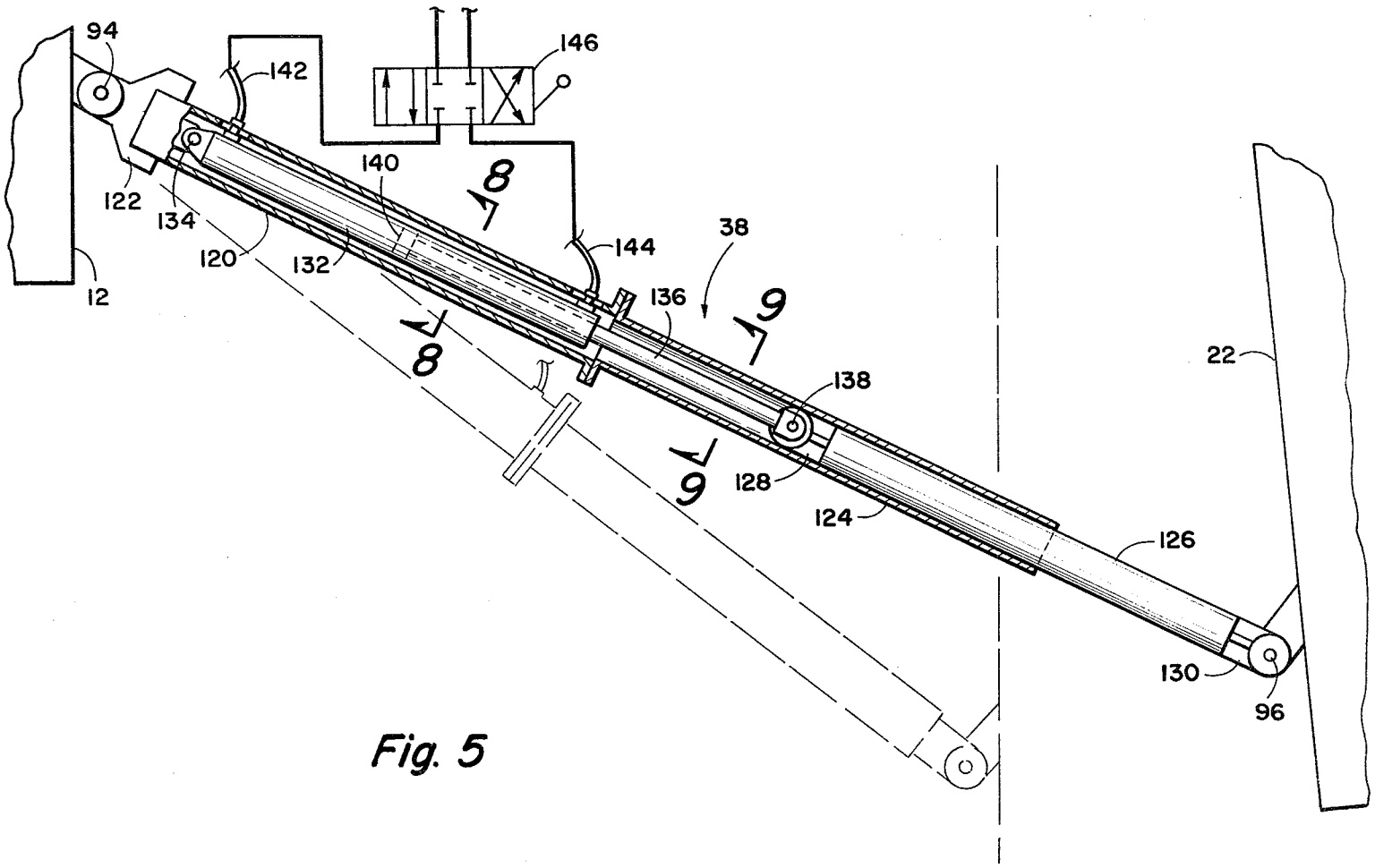
FIG. 5 is a detail of one of the hydraulic jacks of FIG. 4 shown partially in section.
Figure 9:
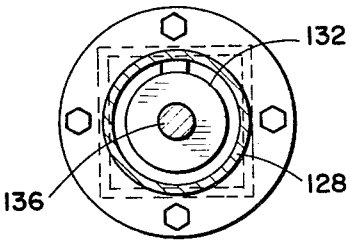
FIG. 9 is an end sectional view of the hydraulic jack of FIG. 5 taken along the broken lines 9—9 of FIG. 5.
Figure 8:
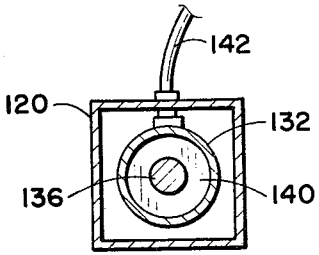
FIG. 8 is a sectional view of the hydraulic cylinder of FIG. 5 taken along the broken lines 8—8 of FIG. 5.

Referring now to FIGS. 5, 8 and 9 of the drawings, the elongated hydraulic jack 38 comprises a first section of elongated tubular steel 120 having a rectangular cross-sectional shape, one end of which is secured to a pivot plate 122 for pivotal attachment to the drilling platform by pivot pin 94.

An elongated tubular sleeve member 124 is rigidly secured to the tubular steel member 120 in end-to-end fashion. An elongated steel rod member 126 is reciprocally disposed within the sleeve member 124 and is provided with pivotal attachment fittings 128 and 130 at either end thereof, the attachment fitting 130 being pivotally connected to the mud tank by pivot pin 96, the opposite fitting 128 being disposed within the sleeve member 124.

An elongated hydraulic cylinder 132 is longitudinally disposed within the tubular steel member 120 and is pivotally attached at one end by a suitable pivot pin 134. An elongated piston rod arm 136 is reciprocally disposed within the cylinder 132, the outer end thereof being pivotally attached to the fitting 128 by a suitable pivot pin 138, the inner end thereof being provided with a piston member 140 which, again, is reciprocally disposed within the cylinder 132.

A pair of hydraulic lines 142 and 144 are operably connected to each end of the cylinder 132 to make the said cylinder double acting, the hydraulic lines 142 and 144 being operably connected to a suitable valve member schematically shown by reference character 146, whereby said cylinder may be operated in either direction or locked in any desired location. It can readily be seen that the cylinder 132 is greatly strengthened against bending forces by the tubular steel members 120, the sleeve member 124 and rod member 126. The hydraulic jack 36 is constructed in a substantially identical manner.

Figure 7:
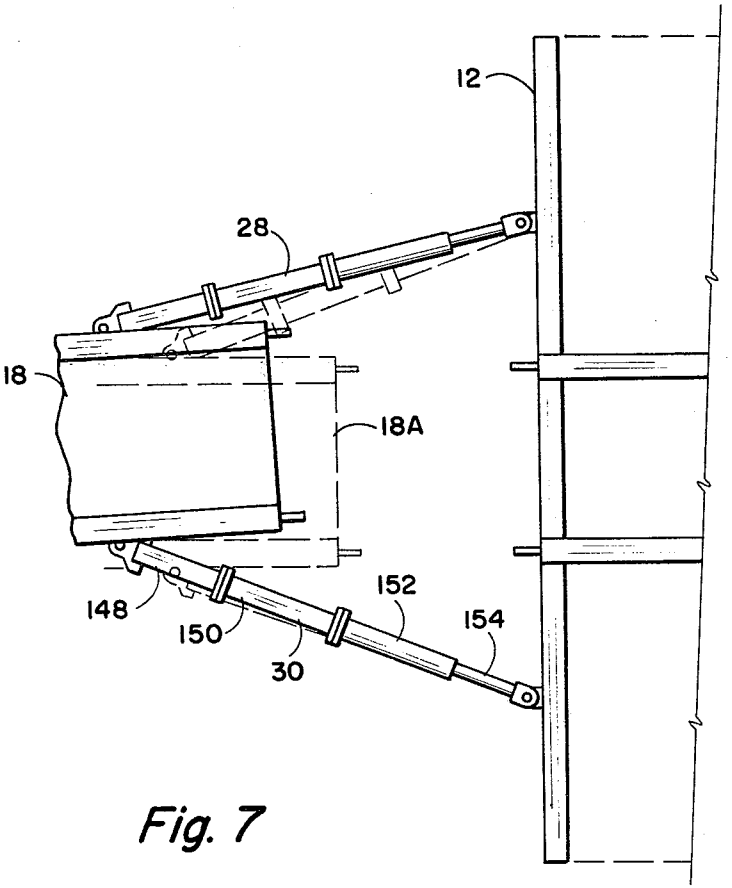
FIG. 7 is a plan view of the relationship of the control room and the drilling platform.

The hydraulic jack 30 as generally shown in FIG. 7 comprises a pair of tubular steel members 148 and 150 secured in end-to-end relationship, the tubular steel members 148 and 150 being similar to the member 120 hereinbefore described. The hydraulic jack 30 further comprises a tubular sleeve member 152 which is similar or identical to the sleeve member 124 hereinbefore described. An elongated rod member 154 is reciprocally disposed within the sleeve member 152, the rod member 154 being similar to the rod member 126 hereinbefore described.

The jack member 30 further comprises a double acting hydraulic cylinder and associated piston rod similar to or identical to the cylinder 132 and piston arm 136, the cylinder being disposed within the tubular steel member 150, the piston rod being operably connected to the elongated rod 154. The opposite hydraulic jack 28 connecting the control room to the drilling platform is constructed substantially identical to the jack 30.

It has been found that for ease of operation the jacks 28, 30, 36 and 38 may be presized in length so that in a fully retracted position the auxiliary structure is pulled into its desired location as shown in the drawings.

Figure 6:
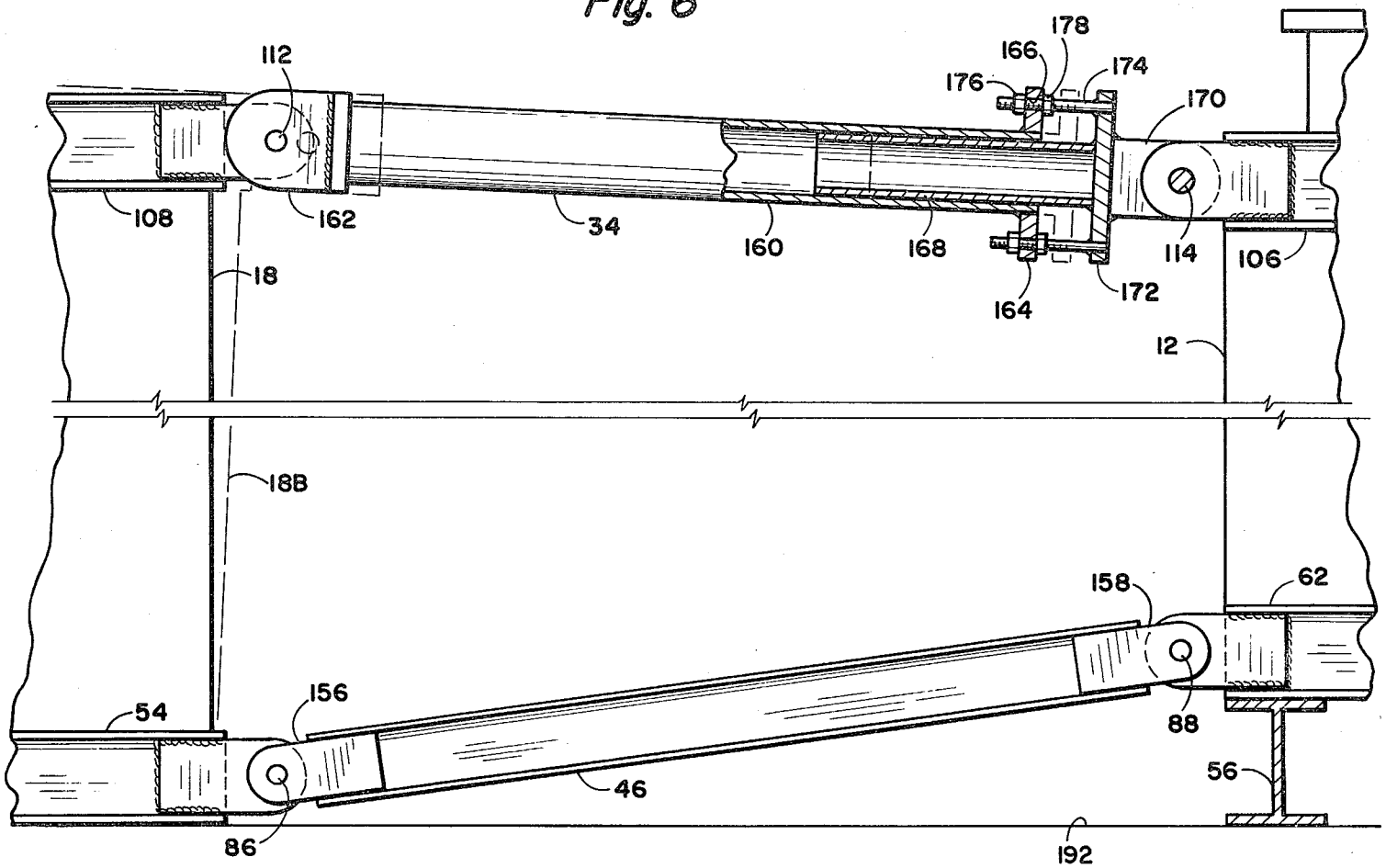
FIG. 6 is a side elevational view of a pair of connecting links between the drilling platform and the control room shown partially in section.

Referring to FIG. 6 of the drawings, the connecting link 46 is constructed of a segment of I-beam, the ends thereof having spaced pairs of pivotal connection fittings 156 and 158 for pivotally connecting the link 46 with skid boom 54 and frame member 62, respectively. The link members 44, 48 and 50 are of similar construction.

The adjustable link member 34 comprises an elongated sleeve segment 160 having one end thereof provided with a pivot attachment member 162 for pivotally attachment to the upper frame member 108. The opposite end of the sleeve member 160 is provided with an outwardly extending flange 164 having a plurality of bores 166 therearound. Link 34 further comprises a rod member 168 which is reciprocally disposed within the sleeve member 160, one end of the rod member being provided with a pivotal attachment fitting 170 for attachment to the upper frame member 106 of the drilling platform 12 by means of the pivot pin 114.

A second flange plate 172 is disposed between the pivot attachment member fitting 170 and the rod member 168. A plurality of elongated threaded stud members 174 have one end secured to the flange plate 172 and extend through the bores 166 of the flange plate 164. Each of the stud members are provided with at least a pair of opposing nut members 176 and 178 which are disposed on the threaded stud 174 and on either side of each bore 166 for adjusting the spacing between the flange plate 164 and 172 and thus, adjusting the length of the connecting link 34. The adjustable connecting links 32, 40 and 42 are similarly constructed.

Referring now to FIG. 1 of the drawings, a pair of outwardly extending attachment members 180 and 182 are secured alongside the control room 18 for the purpose of stowing the hydraulic jacks 28 and 30 when not in use. The jacks are simply disconnected at their outer ends and swung rearwardly so that the outer ends may be attached to the connection members 180 and 182. The jacks 36 and 38 may likewise be stowed alongside the drilling platform by means of the outwardly extending attachment members 184 and 186 in a similar manner.

It is noted by having the cylinder end of the jacks 28 and 30 connected to the control room 18, the hydraulic lines do not have to be disconnected when stowing the jacks. Likewise, by having the cylinder ends of the jacks 36 and 38 connected to the drilling platform 12, hydraulic lines do not have to be disconnected from the jacks when stowing the jacks using the attachment members 184 and 186.

Referring to FIG. 3 of the drawings, an outwardly extending attachment member 188 is secured to the control room 18 above the frame member 54. A similar outwardly extending attachment member 190 is secured to the mud tank above the frame member 66. When the links are not in use, the link 34 may be swung downwardly and attached to the member 188. Also the link 46 may be swung upwardly, about the pin 88, the free end being attached to the frame 106. Likewise, the adjustable link 42 may be disconnected from the platform and swung downwardly and attached to the member 190 and the lower link 50 may be disattached from the mud tank, swung upwardly and connected to the frame member 106. The other connecting links stow in a similar manner.

In FIGS. 3 and 6 of the drawings, the ground level for supporting the drill rig structure is indicated by reference character 192.

In operation, the surface around the proposed drill site is leveled out to form the ground level surface 192. The platform apparatus is then moved into its desired position relative to the proposed bore-hole. The control room may then be positioned about four feet outwardly from its desired location as shown in the plan view of FIG. 7. The hydraulic jacks are then extended and connected to their respective attachment points on the drilling platform 12 as shown in FIG. 7.

Hydraulic power is applied to the jacks, the hydraulic power (not shown) being contained within the control room. The jacks 28 and 30 are then retracted thereby pulling the control room into its desired position as shown by the dashed lines identified by reference character 18A. The linkage arms 44 and 46 are then attached to the base portion of the control room by horizontal pivot pins 82 and 86. The upper connecting links 32 and 34 are then adjusted in length so that they may be connected between the upper portion of the control room and the drilling platform as shown in FIG. 6 of the drawings. The adjustability of the upper links 32 and 34 will accommodate small variations in the surface of the site, as shown by the dashed lines 18B of FIG. 6. At this point, the connecting hydraulic, pneumatic and electrical lines may be attached between the control room 18 and the platform 12.

Figure 4:
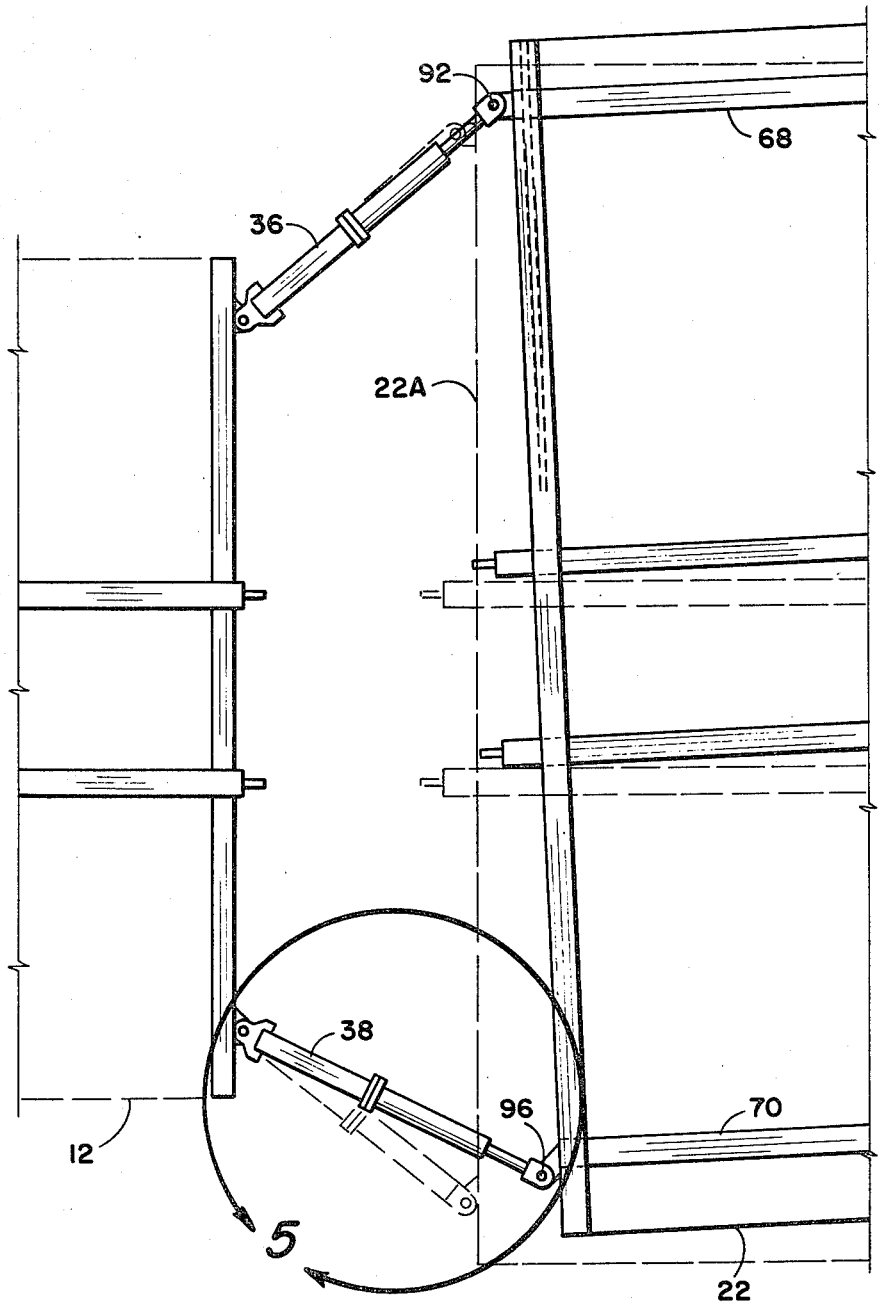
FIG. 4 is a plan view of the relationship of the drilling platform and the mud tank of FIG. 1 before being pulled into position.

The mud tank is then positioned on the opposite side of the platform as shown in FIG. 4, again, four or five feet further away from the platform as its desired location so that the hydraulic jacks 36 and 38 may be swung out of their stowed position outwardly and attached to the mud tank by pivot pins 92 and 96. Hydraulic power is then applied to the jacks 36 and 38 to fully retract the jacks thereby pulling the mud tank into its desired position as indicated by the dashed lines of reference character 22A.

The lower connecting links 48 and 50 are then attached to the mud tank by pivot pins 100 and 104. The upper connecting links 40 and 42 are then adjusted in length and connected between the upper portions of the platform 12 and the mud tank 22 as shown in FIG. 3.

Although it is not necessary in the set-up operation, a quantity of driller's mud (not shown) may be pumped into the tank 22 thereby adding a great amount of weight to the tank for further stability.

The derrick 14 may then be lifted into position to begin the drilling operation. It is noted at this point that the hydraulic jacks may be connected at different points on the platform and the auxiliary structures but should be non-parallel so that when the jacks are activated the structures are pulled into alignment longitudinally, traversely and rotationally about a vertical axis. Further it is noted that it would be feasible to employ only two connecting links between the platform and each auxiliary structure within the scope of the invention, but it is felt that four connecting links should be employed to better distribute loads being transferred therethrough whether they be tension, compression or torsion loads.

Whereas, the present invention has been described in particular relation the drawings attached hereto, other and further modifications apart from those shown or suggested herein may be made with the spirit and scope of the invention.

What is claimed is:

1. An apparatus for aligning and securing an auxiliary structure to a well drilling platform comprising a pair of elongated hydraulic jacks having first ends pivotally secured by substantially vertical pivot pins to a base portion of the platform in a spaced-apart relationship, the second ends of said jacks being pivotally secured by substantially vertical pivot pins to a base portion of the auxiliary structure also in a spaced-apart relationship, at least one lower elongated connecting link of pre-determined length pivotally connectable between the base portions of the drilling platform and the auxiliary structure by substantially horizontal pivot pins, and at least one upper elongated connecting link pivotally connected between upper portions of the drilling platform and the auxiliary structure by substantially horizontal pins whereby said hydraulic jacks may be utilized to position the auxiliary structure with respect to the platform and said connecting links.

2. An apparatus as set forth in claim 1 wherein said upper elongated connecting link is adjustable in length to compensate for a slightly unlevel site.

3. An apparatus as set forth in claim 1 wherein each of the hydraulic jacks comprises a cylinder and cooperating piston arm reciprocally disposed therein, each said jack being pre-sized in length so that when the piston arm is fully retracted, the base portion of said auxiliary structure is positioned at the desired distance from the drilling platform.

4. An apparatus as set forth in claim 3 wherein the cylinders are double acting and the piston arm is hydraulically lockable in any desired position.

5. An apparatus as set forth in claim 1 wherein each said hydraulic jack comprises an elongated strengthened tubular steel housing segment and an elongated steel pipe sleeve rigidly secured in end-to-end relationship, an elongated steel rod member reciprocally disposed within the pipe sleeve, a hydraulic cylinder disposed within the tubular steel segment and a piston arm reciprocally carried by the cylinder and secured to the steel rod member for providing increased lateral strength to said cylinder and cooperating piston arm.

6. An apparatus as set forth in claim 1 wherein the hydraulic jacks are non-parallel forming a substantially Y-shaped configuration about an axis line connecting the platform to the auxiliary structure in its desired location.

7. An apparatus as set forth in claim 6 wherein the upper and lower connecting links are disposed between the hydraulic jacks.

8. An apparatus as set forth in claim 2 and including a second lower connecting link pivotally connected between the base portions of the platform and auxiliary structure and a second upper adjustable connecting link pivotally connected between the upper portions of the platform and auxiliary structure.

9. An apparatus as set forth in claim 8 wherein each of the upper elongated connecting links comprise an elongated sleeve member pivotally connected at one end and having a first flange plate at the opposite end, an elongated rod member pivotally connected at one end, the opposite end being reciprocally disposed in the elongated sleeve member, a second flange plate carried by the rod member and disposed intermediate the second pivot connection and the first flange member, one of said flange members being provided with a plurality of bores therethrough, a plurality of threaded studs carried by the other flange member and being slidably disposed in the bores of the one flange member and adjustable nuts carried by the stud and disposed on either side of the bores for adjusting the distance between the first and second flange members and hence, adjusting the length of each upper connecting link.

10. An apparatus as set forth in claim 1 wherein the auxiliary structure is a control room.

11. An apparatus as set forth in claim 1 wherein the auxiliary structure is a drilling mud tank.

12. An apparatus as set forth in claim 10 wherein the drilling platform is elongated in shape and the control room is elongated in shape and the desired relative position of the control room to the drilling platform is substantially perpendicular, said control room being mounted on skid booms and wherein the hydraulic jacks have said second ends pivotally secured to the opposite sides of the control room, said first ends being securable to the drilling platform in a spaced relationship wider than said control room whereby operation of said hydraulic jacks serves to position said control room with respect to the drilling platform, longitudinally, traversely and rotationally about a vertical axis.

13. An apparatus as set forth in claim 11 wherein the drilling platform is elongated in shape and the mud tank is elongated in shape and the desired relative position of the mud tank with respect to the drilling platform is parallel, the first end of said hydraulic jacks being pivotally connected to the platform in a spaced-apart relationship, the second ends of said hydraulic jacks being pivotally secured to the mud tank in a spaced relationship, the spaced relationship of the pivot connection to the mud tank being wider than those of the drilling platform, the mud tank being mounted on skid booms whereby activation of the hydraulic jacks serves to position the mud tank with respect to the drilling platform, longitudinally, traversely and rotationally about a vertical axis.

14. A system for aligning and securing a mud tank to one side of a drilling platform and a control room to the opposite side of the drilling platform comprising a first pair of non-parallel elongated hydraulic jacks being secured between base portions of the drilling platform and the control room whereupon activation of said first hydraulic jacks positions the control room in its desired location with respect to the drilling platform and a first pair of parallel connecting links pivotally securable between the base portions of the drilling platform and the control room, a second set of connecting links being adjustable in length and disposed in parallel relationship above said first connecting links, said second links being pivotally connected between the upper portions of the control room and the drilling platform, a second set of hydraulic jacks disposed in non-parallel relationship and pivotally connectable between the base portions of the drilling platform and mud tank, a third pair of spaced-apart parallel connecting links pivotally connectable between the base portions of the drilling platform and the mud tank and a fourth pair of parallel connecting links being adjustable in length and pivotally connected between the upper portions of the drilling platform and the mud tank and spaced generally above the third said connecting links whereby said hydraulic jacks may be utilized to position the control room and the mud tank with respect to the drilling platform and said lower connecting links may be attached securing the control room and the mud tank to the drilling platform and said upper connecting links may be adjusted in length to compensate for a slightly unlevel drilling site.

15. An apparatus as set forth in claim 1 and including means for stowing the hydraulic jacks alongside the auxiliary structure when not in use by disconnecting the first ends of the jacks from the drilling platform and pivoting said jacks alongside the auxiliary structure and connecting said first ends to the auxiliary structure.

16. An apparatus as set forth in claim 1 and including means for stowing the hydraulic jacks alongside the drilling platform structure when not in use by disconnecting the first ends of the jacks from the auxiliary structure and pivoting said jacks alongside the drilling platform and connecting said first ends to the drilling platform.

17. An apparatus as set forth in claim 8 and including means carried by the drilling platform for stowing one pair of connecting links to the drilling platform when not in use and means carried by the auxiliary structure for stowing the other pair of connecting links when not in use.

18. A method for aligning and securing an auxiliary structure to a well drilling platform comprising the steps of positioning the auxiliary structure near its desired position with respect to the drilling platform;

connecting a base portion of the drilling platform to a base portion of the auxiliary structure with a pair of spaced-apart non-parallel hydraulic jacks;

hydraulically adjusting the length of said jacks to position the base portion of the auxiliary structure with respect to the base portion of the drilling platform;

further connecting the base portions of the auxiliary structure to the drilling platform with a pair of spaced parallel pivotal connecting links of fixed length.

19. A method as set forth in claim 18 wherein the hydraulic jacks are pre-sized in length so that in a retracted position the auxiliary structure is accurately positioned with respect to the drilling platform and said step of positioning the auxiliary structure near its desired position comprises locating the auxiliary structure at a distance greater than its desired position with respect to the drilling platform whereby retraction of said jacks pulls said auxiliary structure into its desired position.

* * * * *